US009032874B2

(12) United States Patent
Liu et al.

(10) Patent No.: US 9,032,874 B2
(45) Date of Patent: May 19, 2015

(54) DAMPENING FLUID DEPOSITION BY CONDENSATION IN A DIGITAL LITHOGRAPHIC SYSTEM

(75) Inventors: Chu-heng Liu, Penfield, NY (US); Patrick Jun Howe, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 189 days.

(21) Appl. No.: 13/426,262

(22) Filed: Mar. 21, 2012

(65) Prior Publication Data

US 2013/0247788 A1 Sep. 26, 2013

(51) Int. Cl.

| | |
|---|---|
| ***B41F 7/30*** | (2006.01) |
| ***B41F 7/32*** | (2006.01) |
| ***B41N 3/08*** | (2006.01) |
| ***B41F 7/37*** | (2006.01) |
| ***B41F 33/00*** | (2006.01) |

(52) U.S. Cl.

CPC ... *B41F 7/32* (2013.01); *B41N 3/08* (2013.01); *B41F 7/37* (2013.01); *B41F 33/0054* (2013.01); *B41F 7/30* (2013.01); *B41P 2227/70* (2013.01)

(58) Field of Classification Search

CPC ..... B41F 7/24; B41F 7/30; B41F 7/32; B41F 7/37; B41F 33/0054; B41L 25/00; B41N 3/08; B41C 1/1033

USPC ..... 101/147, 451

See application file for complete search history.

(56) References Cited

U.S. PATENT DOCUMENTS

| | | | | |
|---|---|---|---|---|
| 3,686,771 | A * | 8/1972 | Schone et al. | 34/526 |
| 3,741,118 | A | 6/1973 | Carley | |
| 3,800,699 | A | 4/1974 | Carley | |
| 3,877,372 | A | 4/1975 | Leeds | |
| 4,627,349 | A | 12/1986 | Claussen | |
| 4,887,528 | A | 12/1989 | Ruge | |
| 5,067,404 | A | 11/1991 | Frunder et al. | |
| 5,701,815 | A | 12/1997 | Bocko | |
| 5,855,173 | A | 1/1999 | Chatterjee et al. | |

(Continued)

FOREIGN PATENT DOCUMENTS

| | | |
|---|---|---|
| DE | 101 60 734 A1 | 7/2002 |
| DE | 103 60 108 A1 | 7/2004 |

(Continued)

OTHER PUBLICATIONS

Shen et al., "A new understanding on the mechanism of fountain solution in the prevention of ink transfer to the non-image area in conventional offset lithography", J. Adhesion Sci. Technol., vol. 18, No. 15-16, pp. 1861-1887 (2004).

(Continued)

*Primary Examiner* — Blake A Tankersley

(74) *Attorney, Agent, or Firm* — Ronald E. Prass, Jr.; Prass LLP

(57) ABSTRACT

A system and corresponding methods are disclosed for depositing of a layer of dampening fluid to a reimageable surface of an imaging member in a variable data lithography system by way of condensation. Dampening fluid in an airborne state is introduced proximate the reimageable surface in a condensation region. Conditions in the condensation region are such that the airborne dampening fluid preferentially condenses on the reimageable surface in a precisely controlled quantity, to thereby form a precisely controlled layer of dampening fluid of desired thickness over the reimageable surface. Among other advantages, improved print quality is obtained.

17 Claims, 8 Drawing Sheets

(56) References Cited

U.S. PATENT DOCUMENTS

| | | | | |
|---|---|---|---|---|
| 5,894,795 | A * | 4/1999 | Gagne et al. | 101/148 |
| 6,125,756 | A | 10/2000 | Nussel et al. | |
| 6,146,798 | A | 11/2000 | Bringans et al. | |
| 6,318,264 | B1 | 11/2001 | D'Heureuse et al. | |
| 6,561,090 | B1 | 5/2003 | Spooner | |
| 6,725,777 | B2 | 4/2004 | Katano | |
| 6,841,366 | B1 | 1/2005 | Bower et al. | |
| 6,901,853 | B2 | 6/2005 | Baldy et al. | |
| 7,020,355 | B2 | 3/2006 | Lahann et al. | |
| 7,061,513 | B2 | 6/2006 | Katano et al. | |
| 7,100,503 | B2 | 9/2006 | Wiedemer et al. | |
| 7,191,705 | B2 | 3/2007 | Berg et al. | |
| 2003/0167950 | A1 | 9/2003 | Mori | |
| 2004/0011234 | A1 | 1/2004 | Figov | |
| 2005/0178281 | A1 | 8/2005 | Berg et al. | |
| 2005/0258136 | A1 | 11/2005 | Kawanishi | |
| 2006/0152566 | A1 | 7/2006 | Taniuchi | |
| 2007/0199457 | A1 | 8/2007 | Cyman, Jr. et al. | |
| 2007/0199458 | A1 | 8/2007 | Cyman, Jr. et al. | |
| 2007/0199459 | A1 | 8/2007 | Cyman, Jr. et al. | |
| 2007/0199460 | A1 | 8/2007 | Cyman, Jr. et al. | |
| 2007/0199461 | A1 | 8/2007 | Cyman, Jr. et al. | |
| 2007/0199462 | A1 | 8/2007 | Cyman, Jr. et al. | |
| 2008/0011177 | A1 | 1/2008 | Muraoka | |
| 2008/0032072 | A1 | 2/2008 | Taniuchi | |
| 2008/0223240 | A1 | 9/2008 | Drury | |
| 2010/0031838 | A1 | 2/2010 | Lewis et al. | |

FOREIGN PATENT DOCUMENTS

| | | | | |
|---|---|---|---|---|
| DE | 10 2006 050744 | A1 | 4/2008 | |
| DE | 10 2008 062741 | | 7/2010 | |
| EP | 1 935 640 | A2 | 6/2008 | |
| EP | 1 938 987 | A2 | 7/2008 | |
| EP | 1 964 678 | A2 | 9/2008 | |
| EP | 11187189.3 | | 5/2012 | |
| EP | 11187190.1 | | 5/2012 | |
| EP | 11187191.9 | | 5/2012 | |
| EP | 11187192.7 | | 5/2012 | |
| EP | 11187193.5 | | 5/2012 | |
| EP | 11187195.0 | | 5/2012 | |
| EP | 11187196.8 | | 5/2012 | |
| JP | 58168564 | * | 10/1983 | B41F 7/30 |
| WO | WO-9736746 | * | 10/1997 | B41F 7/24 |
| WO | 2006/133024 | A2 | 12/2006 | |
| WO | WO 2009025821 | A1 | 2/2009 | |

OTHER PUBLICATIONS

Katano et al., "The New Printing System Using the Materials of Reversible Change of Wettability", International Congress of Imaging Science 2002, Tokyo, pp. 297 et seq. (2002).
Kjelgaard, M., "Humidification Side by Side", Engineered Systems Mag., (Troy, MI 2002).
Turpin, Joanna, "Ultrasonic Humidification is Ultra-Efficient", Engineered SYstems Mag., (Troy, MI 2003).
U.S. Appl. No. 13/095,714, filed Apr. 27, 2011, Stowe et al.
U.S. Appl. No. 13/095,737, filed Apr. 27, 2011, Stowe et al.
U.S. Appl. No. 13/095,745, filed Apr. 27, 2011, Stowe et al.
U.S. Appl. No. 13/095,757, filed Apr. 27, 2011, Stowe et al.
U.S. Appl. No. 13/095,764, filed Apr. 27, 2011, Stowe et al.
U.S. Appl. No. 13/095,773, filed Apr. 27, 2011, Stowe et al.
U.S. Appl. No. 13/095,778, filed Apr. 27, 2011, Stowe et al.
U.S. Appl. No. 13/204,515, filed Aug. 5, 2011, Stowe et al.
U.S. Appl. No. 13/204,526, filed Aug. 5, 2011, Stowe et al.
U.S. Appl. No. 13/204,548, filed Aug. 5, 2011, Stowe et al.
U.S. Appl. No. 13/204,560, filed Aug. 5, 2011, Pattekar et al.
U.S. Appl. No. 13/204,567, filed Aug. 5, 2011, Stowe et al.
U.S. Appl. No. 13/204,578, filed Aug. 5, 2011, Stowe et al.
U.S. Appl. No. 13/366,947, filed Feb. 6, 2012, Biegelsen.
U.S. Appl. No. 13/426,209, filed Mar. 21, 2012, Liu et al.

* cited by examiner

DAMPENING FLUID DEPOSITION BY CONDENSATION IN A DIGITAL LITHOGRAPHIC SYSTEM

BACKGROUND

The present disclosure is related to marking and printing methods and systems, and more specifically to methods and systems for precisely depositing a dampening fluid (such as a water-based fountain fluid) in a variable lithography marking or printing system.

Offset lithography is a common method of printing. (For the purposes hereof, the terms "printing" and "marking" are used interchangeably.) In a typical lithographic process the surface of a print image carrier, which may be a flat plate, cylinder, belt, etc., is formed to have "image regions" of hydrophobic and oleophilic material, and "non-image regions" of a hydrophilic material. The image regions correspond to the areas on the final print (i.e., the target substrate) that are occupied by a printing or marking material such as ink, whereas the non-image regions are the regions corresponding to the areas on the final print that are not occupied by said marking material. The hydrophilic regions accept and are readily wetted by a water-based dampening fluid (commonly referred to as a fountain solution, and typically consisting of water and a small amount of alcohol as well as other additives and/or surfactants). The hydrophobic regions repel dampening fluid and accept ink, whereas the dampening fluid formed over the hydrophilic regions forms a fluid "release layer" for rejecting ink. Therefore the hydrophilic regions of the printing plate correspond to unprinted areas, or "non-image areas", of the final print.

The ink may be transferred directly to a substrate, such as paper, or may be applied to an intermediate surface, such as an offset (or blanket) cylinder in an offset printing system. The offset cylinder is covered with a conformable coating or sleeve with a surface that can conform to the texture of the substrate, which may have surface peak-to-valley depth somewhat greater than the surface peak-to-valley depth of the imaging plate. Sufficient pressure is used to transfer the image from the offset cylinder to the substrate. Pinching the substrate between the offset cylinder and an impression cylinder provides this pressure.

The above-described lithographic and offset printing techniques utilize plates which are permanently patterned, and are therefore useful only when printing a large number of copies of the same image (long print runs), such as magazines, newspapers, and the like. However, they do not permit creating and printing a new pattern from one page to the next without removing and replacing the print cylinder and/or the imaging plate (i.e., the technique cannot accommodate true high speed variable data printing wherein the image changes from impression to impression, for example, as in the case of digital printing systems). Furthermore, the cost of the permanently patterned imaging plates or cylinders is amortized over the number of copies. The cost per printed copy is therefore higher for shorter print runs of the same image than for longer print runs of the same image, as opposed to prints from digital printing systems.

Lithography and the so-called waterless process provide very high quality printing, in part due to the quality and color gamut of the inks used. Furthermore, these inks—which typically have a very high color pigment content (typically in the range of 20-70% by weight)—are very low cost compared to toners and many other types of marking materials. However, while there is a desire to use the lithographic and offset inks for printing in order to take advantage of the high quality and low cost, there is also a desire to print variable data from page to page. Heretofore, there have been a number of hurdles to providing variable data printing using these inks. Furthermore, there is a desire to reduce the cost per copy for shorter print runs of the same image. Ideally, the desire is to incur the same low cost per copy of a long offset or lithographic print run (e.g., more than 100,000 copies), for medium print run (e.g., on the order of 10,000 copies), and short print runs (e.g., on the order of 1,000 copies), ultimately down to a print run length of 1 copy (i.e., true variable data printing).

One problem encountered is that the viscosity of offset inks are generally too high (often well above 50,000 cps) to be useful in nozzle-based inkjet systems. In addition, because of their tacky nature, offset inks have very high surface adhesion forces relative to electrostatic forces and are therefore almost impossible to manipulate onto or off of a surface using electrostatics. (This is in contrast to dry or liquid toner particles used in xerographic/electrographic systems, which have low surface adhesion forces due to their particle shape and the use of tailored surface chemistry and special surface additives.)

Efforts have been made to create lithographic and offset printing systems for variable data in the past. One example is disclosed in U.S. Pat. No. 3,800,699, incorporated herein by reference, in which an intense energy source such as a laser is used to pattern-wise evaporate a dampening fluid.

In another example disclosed in U.S. Pat. No. 7,191,705, incorporated herein by reference, a hydrophilic coating is applied to an imaging belt. A laser selectively heats and evaporates or decomposes regions of the hydrophilic coating. A water based dampening fluid is then applied to these hydrophilic regions, rendering them oleophobic. Ink is then applied and selectively transfers onto the plate only in the areas not covered by dampening fluid, creating an inked pattern that can be transferred to a substrate. Once transferred, the belt is cleaned, a new hydrophilic coating and dampening fluid are deposited, and the patterning, inking, and printing steps are repeated, for example for printing the next batch of images.

In the aforementioned lithographic systems it is very important to have an initial layer of dampening fluid that is of a uniform and desired thickness. To accomplish this, a form roller nip wetting system, which comprises a roller fed by a solution supply, is brought proximate the reimageable surface. Dampening fluid is then transferred from the form roller to the reimageable surface. However, such a system relies on the mechanical integrity of the form roller and the reimageable surface, the surface quality of the form roller and the reimageable surface, the rigidity of the mounting maintaining spacing between the form roller and the reimageable surface, and so on to obtain a uniform layer. Mechanical alignment errors, positional and rotational tolerances, and component wear each contribute to variation in the roller-surface spacing, resulting in deviation of the dampening fluid thickness from ideal.

Furthermore, an artifact known as ribbing instability in the roll-coating process leads to a non-uniform dampening fluid layer thickness. This variable thickness manifests as streaks or continuous lines in a printed image.

Still further, while great efforts are taken to clean the roller after each printing pass, in some systems it is inevitable that contaminants (such as ink from prior passes) remain on the reimageable surface when a layer of dampening fluid is applied. The remaining contaminants can attach themselves to the form roller that deposits the dampening fluid. The roller may thereafter introduce image artifacts from the contaminants into subsequent prints, resulting in an unacceptable final print.

In addition, cavitation may occur on the form roller in the transfer nip due to Taylor instabilities (see, e.g., "An Outline of Rheology in Printing" by W. H. Banks, in the journal Rheologica Acta, pp. 272-275 (1965)), incorporated herein by reference. To avoid these instabilities, systems have been designed with multiple rollers that move back and forth in the axial direction while also moving in rolling contact with the form roller, to break up the rib and streak formation. However, this roller mechanism adds delay in the "steadying out" of the dampening system so printing cannot start until the dampening fluid layer thickness has stabilized on all the roller surfaces. Also, on-the-fly dampening fluid flow control is not possible since the dampening fluid layer is at that point already built up on the form roller and the other dampening system rollers acts as a buffering mechanism.

Accordingly, efforts have been made to develop systems to deposit dampening fluid directly on the offset plate surface as opposed to on intermediate rollers or a form roller. One such system sprays the dampening fluid onto the reimageable offset plate surface. See, e.g., U.S. Pat. No. 6,901,853 and U.S. Pat. No. 6,561,090. However, due to the fact that these dampening systems are used with conventional (pre-patterned) offset plates, the mechanism of transfer of the dampening fluid to the offset plate includes a 'forming roller' that is in rolling contact with the offset plate cylinder to transfer the FS to the plate surface in a pattern-wise fashion—since it is the nip action of contact rolling between the form roller and the patterned offset plate surface that squeezes out the fountain solution from the hydrophobic regions of the offset plate, allowing the subsequent ink transfer selectivity mechanism to work as desired.

While these spray dampening systems provide the advantage of metering the flow rate of the dampening fluid through control of the spray system, as well as the ability to manipulate the dampening fluid layer thickness on-the-fly as needed, the requirement of using the dampening system form roller as the final means of transferring the dampening fluid to the plate surface reintroduces the disadvantages of thickness variation, roller contamination, roller cavitation, and so on. Furthermore, while the dampening fluid is typically less than one micron in thickness, such systems are not able to accommodate a relatively wide thickness range of the dampening fluid in this less-than-one micron regime.

For further reference, additional methods of applying dampening fluid to a reimageable surface are disclosed in U.S. patent application Ser. No. 13/204,515, filed on Aug. 5, 2011, which is incorporated herein by reference.

SUMMARY

The present disclosure is directed to systems and methods for applying a dampening fluid directly to a reimageable surface of a variable data lithographic system. Systems and methods are disclosed that provide a condensation region in which a dampening fluid provided in an airborne state, preferably as vapor, may condense on a reimageable surface to form a dampening fluid layer of a desired thickness.

A system and corresponding methods are disclosed herein for applying a dampening fluid to a reimageable surface of an imaging member in a variable data lithography system, comprising a subsystem for heating a dampening fluid so as to produce a vapor form thereof (herein referred to as a dampening fluid "steam"), a subsystem for directing flow of said dampening fluid steam to the reimageable surface, and a subsystem for condensing the steam onto a reimageable surface of an imaging member whereby the dampening fluid steam reverts to a continuous liquid layer directly on, and is thereby deposited on, the reimageable surface to form a dampening fluid layer of controlled thickness and surface quality.

A number of alternative systems and methods may be used for converting the liquid dampening fluid to steam, including direct application of heat to a dampening fluid bath, indirect application of heat to a dampening fluid bath, application of radiation (such as microwave radiation) to a dampening fluid bath, and so forth. Similarly, a number of alternative systems and methods may be used for converting the dampening fluid steam to a liquid on the reimageable surface, including applying the steam to a relatively cooler reimageable surface, constraining the steam to a condensation region between a condensation flow control structure in the form of a manifold or plate and a reimageable surface, and so forth.

Various feedback and control systems may be provided to measure the thickness of the layer of dampening fluid applied to the reimageable surface, and control, dynamically or otherwise, aspects of the steam delivery and condensation process to obtain and maintain a desired layer thickness. An optical sensor and feedback signals therefrom for controlling the volume, temperature, saturation, and so forth of the dampening fluid steam may be provided for this purpose.

The system and methods disclosed herein provide a number of advantages over known methods, including but not limited to: uniformity of the deposited dampening fluid layer, both at the micro- and macro-scale; accuracy of layer thickness formed over the reimageable surface; provision of a very thin dampening fluid layer over the reimageable surface, with control over that layer thickness on the order of tenths or hundredths of a micron; variable speed deposition of dampening fluid adjustable with print process rate; scalability from small to large substrate sizes and low to high print volumes; and low or no loss (waste) for cost savings, reducing environmental impact, and so on.

The above is a summary of a number of the unique aspects, features, and advantages of the present disclosure. However, this summary is not exhaustive. Thus, these and other aspects, features, and advantages of the present disclosure will become more apparent from the following detailed description and the appended drawings, when considered in light of the claims provided herein.

BRIEF DESCRIPTION OF THE DRAWINGS

In the drawings appended hereto like reference numerals denote like elements between the various drawings. While illustrative, the drawings are not drawn to scale. In the drawings.

DETAILED DESCRIPTION

We initially point out that description of well-known starting materials, processing techniques, components, equipment, and other established details are merely summarized or are omitted so as not to unnecessarily obscure the details of the present invention. Thus, where details are otherwise well known, we leave it to the application of the present invention to suggest or dictate choices relating to those details.

Figure 1:
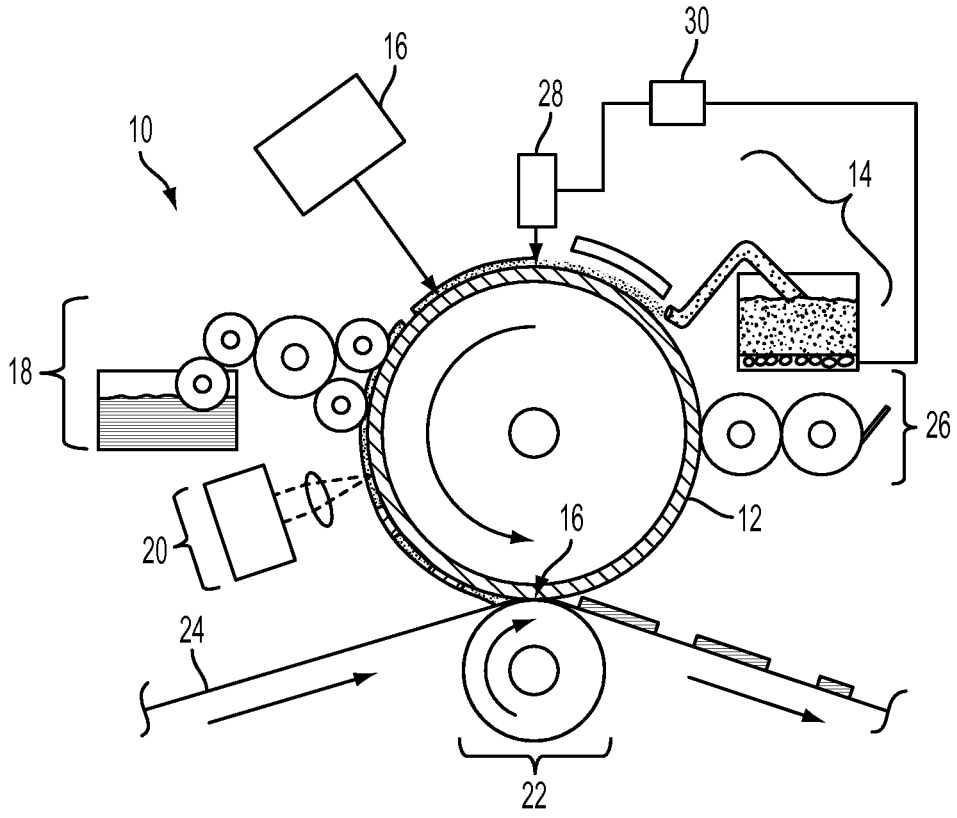
FIG. 1 is a side view of a system for variable lithography according to an embodiment of the present disclosure.

With reference to FIG. 1, there is shown therein a system 10 for variable data lithography according to one embodiment of the present disclosure. System 10 comprises an imaging member 12, in this embodiment a drum, but may equivalently be a plate, belt, etc., surrounded by condensation-based dampening fluid subsystem 14, discussed in further detail below, optical patterning subsystem 16, inking subsystem 18, transfer subsystem 22 for transferring an inked image from the surface of imaging member 12 to a substrate 24, and finally surface cleaning subsystem 26. Other optional other elements include a rheology (complex viscoelastic modulus) control subsystem 20, a thickness measurement subsystem 28, control subsystem 30, etc. Many additional optional subsystems may also be employed, but are beyond the scope of the present disclosure. Many of these subsystems, as well as operation of the system as a whole, are described in further detail in the U.S. patent application Ser. No. 13/095,714, which is incorporated herein by reference.

The key requirement of condensation-based dampening fluid subsystem 14 is to deliver a layer of dampening fluid having a relatively uniform and controllable thickness over a reimageable surface layer over imaging member 12. In one embodiment this layer is in the range of 0.1 μm to 1.0 μm.

The dampening fluid must have the property that it wets and thus tends to spread out on contact with the reimageable surface. Depending on the surface free energy of the reimageable surface the dampening fluid itself may be composed mainly of water, optionally with small amounts of isopropyl alcohol or ethanol added to reduce its natural surface tension as well as lower the evaporation energy necessary for subsequent laser patterning. In addition, a suitable surfactant may be added in a small percentage by weight, which promotes a high amount of wetting to the reimageable surface layer. In one embodiment, this surfactant consists of silicone glycol copolymer families such as trisiloxane copolyol or dimethicone copolyol compounds which readily promote even spreading and surface tensions below 22 dynes/cm at a small percentage addition by weight. Other fluorosurfactants are also possible surface tension reducers. Optionally the dampening fluid may contain a radiation sensitive dye to partially absorb laser energy in the process of patterning. Optionally the dampening fluid may be non-aqueous consisting of, for example, silicone fluids, polyfluorinated ether or fluorinated silicone fluid.

Due to the nature of vaporization-condensation process, the composition of the dampening fluid is preferred to have all the ingredients with relatively low boiling point (< about 250° C.). The non-aqueous dampening fluid options can take advantage of this invention readily because typically they do not need to have extra surfactant to enhance the wetting properties.

In the description of embodiments that follow it will be appreciated that as there is no pre-formed hydrophilic-hydrophobic pattern on a printing plate in system 10. A laser (or other radiation source) is used to form pockets in, and hence pattern, the dampening fluid. The characteristics of the pockets (such as depth and cross-sectional shape), which determine the quality of the ultimate printed image, are in large part a function of the effect that the laser has on the dampening fluid. This effect is to a large degree influenced by the thickness of the dampening fluid at the point of incidence of the laser. Therefore, to obtain a controlled and preferred pocket shape, it is important to control and make uniform the thickness of the dampening fluid layer, and to do so without introducing unwanted artifacts into the printed image.

Figure 2:
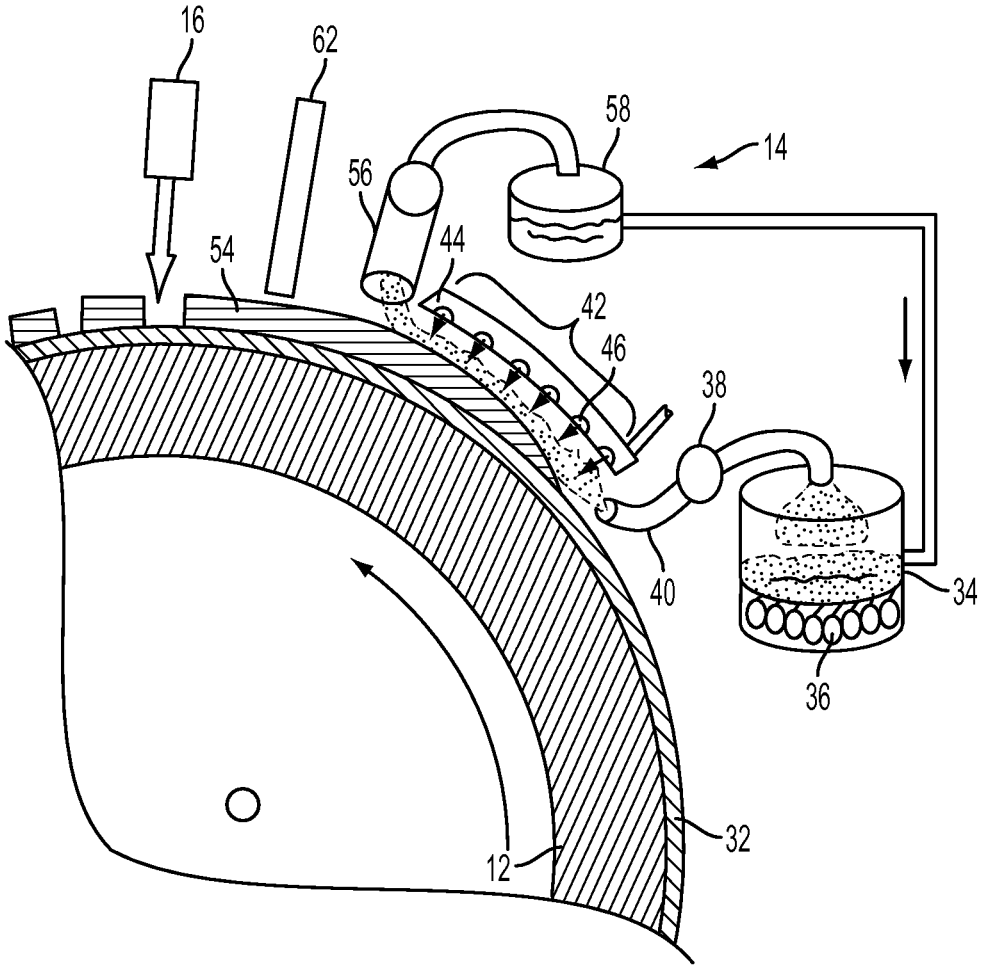
FIG. 2 is a side view of a portion of a system for variable lithography including a condensation-based dampening fluid subsystem according to an embodiment of the present disclosure.

Accordingly, with reference to FIG. 2, there is shown therein a more detailed view of condensation-based dampening fluid subsystem 14 according to an embodiment of the present disclosure. Evaporative thickness control subsystem 28 is disposed proximate an imaging member 12 having a reimageable surface 32. Condensation-based dampening fluid subsystem 14 comprises a reservoir 34 that contains an appropriate dampening fluid in liquid state. This dampening fluid may be converted into dampening fluid steam by a number of different methods, such as heating the liquid state fluid to a boil by a heating element 36, such as resistive heating coils, radiation source (e.g., microwave), optical source (e.g., laser), conductive source (e.g., a heated fluid carried by conduit), or other methods. Dampening fluid in a steam state may be transported from reservoir 34 by a pump 38 and conduit 40 to a condensation region 42 proximate reimageable surface 32.

A flow control structure in the form of manifold 44 is disposed proximate reimageable surface 32 in condensation region 42. Manifold 44 may have one or more slots or nozzles 46 disposed such that a pressurized gas exits therefrom in the direction of reimageable surface 32, or alternatively also in the direction of travel of imaging member 12. Therefore, the dampening fluid steam may travel with the rotation of imaging member 12 or be directed onto the reimageable surface 32, or both. The selection and control of this direction of dampening fluid steam will have a direct impact of the degree of condensation and ultimately the thickness of the dampening fluid layer deposited over the reimageable surface 32. The choice of direction will depend on the particular application, but considerations include possible affects on the downstream layer thickness and other subsystems and elements located downstream of condensation-based dampening fluid subsystem 14.

Figure 3:
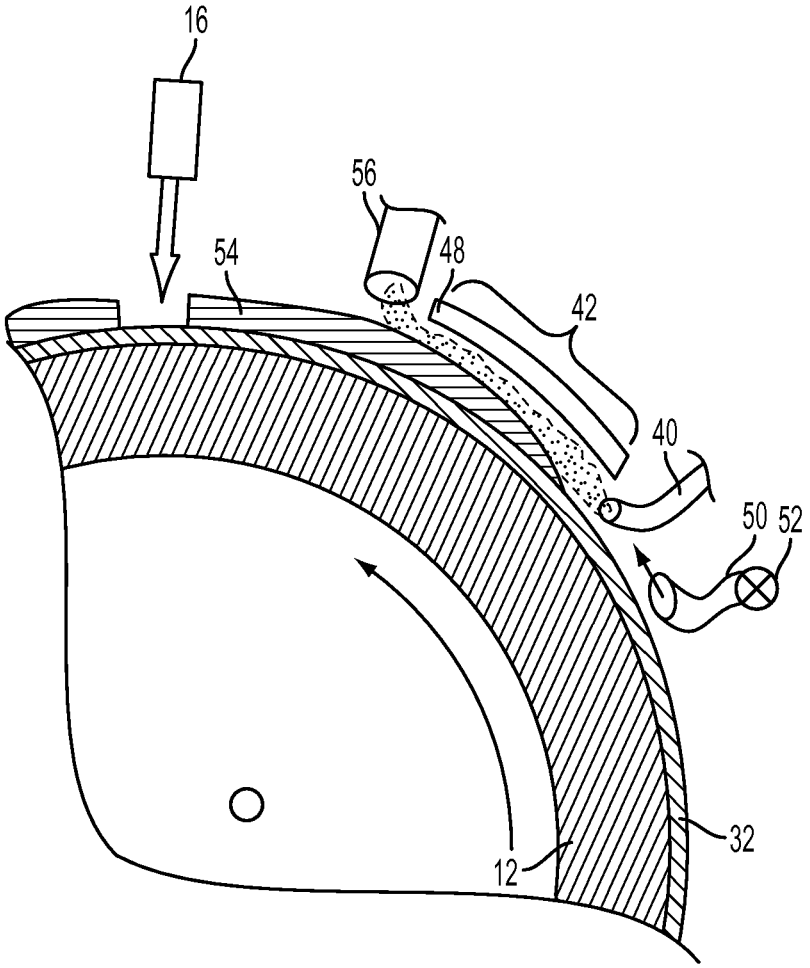
FIG. 3 is a side view of a portion of a system for variable lithography including a condensation-based dampening fluid subsystem according to another embodiment of the present disclosure.

While in the present embodiment the transport of dampening fluid steam in condensation region 42 is provided by the pressure and direction the steam exits conduit 40, and to a certain degree the rotation of imaging member 12, many other embodiment for such transport are contemplated herein. With reference to FIG. 3, another embodiment of the present disclosure comprises a transport gas source 50 and associated control 52 that directs a gas flow toward condensation region 42 between reimageable surface 32 and a flow control structure in the form of plate 48 (in place of manifold 44 of FIG. 2). Steam exiting conduit 40 is transported by gas (e.g., air) exiting source 50 into condensation region 42.

In either case (and returning to FIG. 2), dampening fluid settles from its steam state into a liquid state on reimageable surface 32, forming a dampening fluid layer 54. Excess dampening fluid in the steam state may be retrieved by a vacuum extraction subsystem 56. In certain embodiments, extracted dampening fluid may be recycled, stored in a reservoir 58, and reused to generate additional dampening fluid steam.

According to embodiments of the present disclosure, effective vapor condensation may be obtained by providing the dampening fluid steam to condensation zone 42 at a significantly higher vapor pressure than the saturated vapor pressure at the temperature of reimageable surface 32 during dampening fluid deposition. This can be achieved by generating the dampening fluid steam at an elevated temperature in reservoir 34. Furthermore, to assist with preventing the dampening fluid steam from condensing on manifold 44 (or flow control plate 48, FIG. 3), the temperature thereof may be raised above the temperature of reimageable surface 32 during dampening fluid deposition, and possibly above the temperature of the dampening fluid steam itself.

Exemplary dampening fluids include Water, Novec 7600 (1,1,1,2,3,3-Hexafluoro-4-(1,1,2,3,3,3-hexafluoropropoxy) pentane and has CAS #870778-34-0.), and D4 (octamethylcyclotetrasiloxane). Focusing for example on D4, this material has a vapor pressure of ~1 mmHg at room temperature, ~10 mm Hg at 60° C., and 760 mm Hg at 172° C. (boiling point). If saturated dampening fluid steam at 60° C. is fully condensed onto the reimageable surface 32 at 25° C., 9 mm Hg worth of steam will transition (condense) into liquid phase. The amount of condensation determines the thickness of layer 32, and is determined and controlled by many factors such as dampening fluid steam flow rate through conduit 40, the temperature of the steam exiting conduit 40, the temperatures of the reimageable surface 32 and manifold 44 (plate 48), the length of time the dampening fluid is exposed to reimageable surface 32 and to air in and around the condensation region 42 (such as the length of manifold 44 or plate 48), and so on. In one embodiment, the target thickness for the liquid dampening fluid layer 54 is 0.1-0.4 μm, very achievable by the structures and methods described above. Therefore, control of layer thickness to a first-order may be determined based on the conditions listed above, and possibly others, given the application of the present disclosure. Higher-order (more precise) control over layer thickness may be provided by a feedback mechanism discussed further below.

One goal of the present disclosure is to provide a system and method for forming a precise dampening fluid layer thickness for accurate patterning by optical patterning subsystem 16. In this regard, it is important that dampening fluid steam not settle on the surface of layer 54 following condensation region 42 in the direction of travel of imaging member 12. It is also important that the dampening fluid steam and/or transport gas exiting conduit 40 (or transport gas source 50, FIG. 3) not further disturb the surface of layer 54 following condensation region 42. Therefore, in addition to vacuum extraction subsystem 56 a barrier structure 62 may be disposed between optical patterning subsystem 16 and condensation-based dampening fluid subsystem 14.

Figure 4:
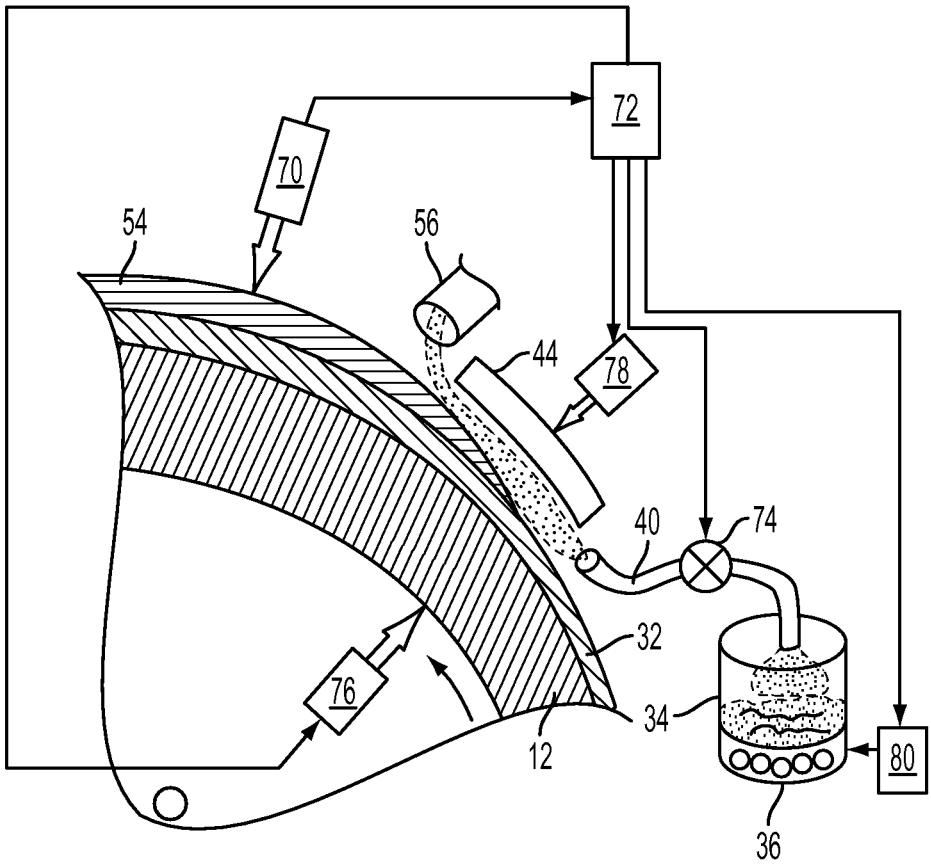
FIG. 4 is a side view of a portion of a system for variable lithography including a condensation-based dampening fluid subsystem according to a further embodiment of the present disclosure.

According to certain embodiments of the present disclosure, the thickness of the layer 54 is determined by an appropriate method and system, such as an optical thickness measurement device 70 illustrated in FIG. 4. The measured thickness of layer 54 may be used to confirm that condensation-based dampening fluid subsystem 14 is operating properly. It may also be used to manually or automatically adjust the operation of condensation-based dampening fluid subsystem 14 or the attributes of other elements of the printing system to obtain a target thickness for layer 54. In the later case, the output of optical thickness measurement device 70 is provided to a control device 72. Control device 72 compares the thickness measurement from device 70 to a target thickness, and sends an appropriate feedback signal to a flow control device, for example to valve 74 (e.g., a servo-operated valve), fan speed controller (not shown), and so on, if needed to increase or decrease the flow of dampening fluid steam to obtain the appropriate thickness of layer 54.

Alternatively, or in addition to providing the feedback signal to control valve 74, the feedback signal may be provided to: control device 76 for controlling the temperature of reimageable surface 32 (such as an optical heating element); control device 78 for controlling the temperature of manifold 44 (or plate 48); control device 80 for controlling heating element 36 for heating of dampening fluid in reservoir 34 to generate dampening fluid steam (and thereby control the temperature of the dampening fluid steam so generated). Other conditions that may be controlled by the results of thickness measurement device 70 include, but are not limited to: an apparatus that controls the vapor concentration of the dampening fluid (also known as humidity if the dampening fluid is water) of the ambient in which the printing device is operated; an apparatus that controls the temperature of the ambient in which the printing device is operated; and an apparatus that controls the rotation speed of the imaging member 12 (controlling the exposure time or distance of the dampening fluid steam). In these embodiments, control of each one or more of these subsystems, devices, and ultimately the conditions in which the dampening fluid is deposited prior to patterning operate as a feedback loop. This feedback loop may operate continuously and sufficiently rapidly that substantially real-time layer thickness control may be provided, to hundredths of a micron or greater accuracy.

Figure 5:
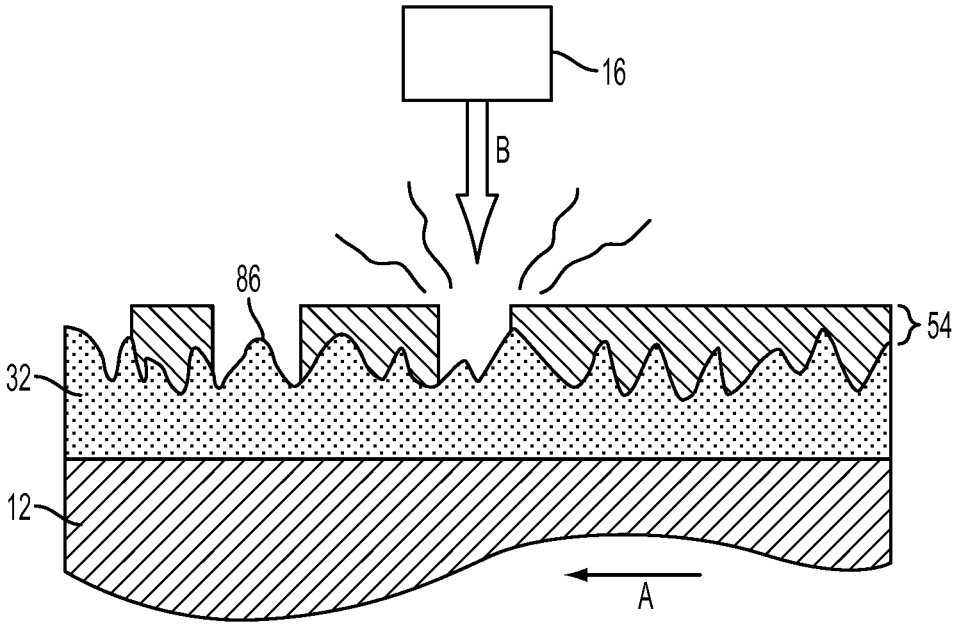
FIG. 5 is a cutaway view of a portion of an imaging member with a patterned dampening fluid layer disposed thereover according to an embodiment of the present disclosure.

Finally, layer 54 is brought past optical patterning subsystem 16, which is used to selectively form an image in the dampening fluid by image-wise evaporating the dampening fluid layer using laser energy, for example. With reference to FIG. 5, which is a magnified view of a region of imaging member 12 and reimageable surface 32 having a layer of dampening fluid 54 applied thereover, the application of optical patterning energy (e.g., beam B) from optical patterning subsystem 16 results in selective evaporation of portions of layer 54. This produces a pattern of ink-receiving wells 86 in the dampening fluid. Relative motion between imaging member 12 and optical patterning subsystem 16, for example in the direction of arrow A, permits a process-direction patterning of layer 54.

Figure 6:
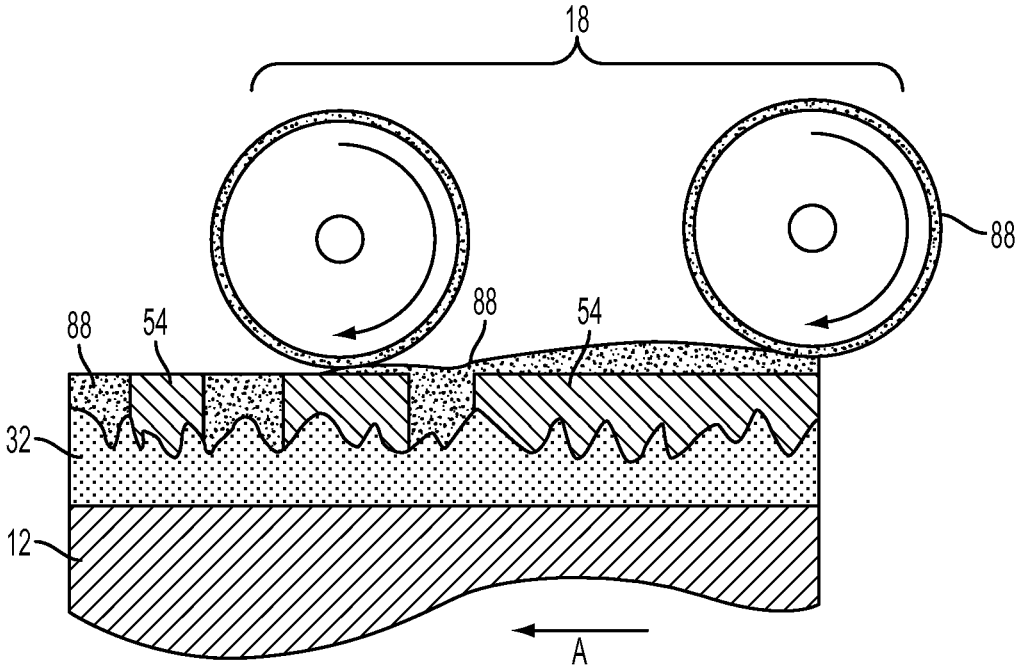
FIG. 6 is a cutaway view of a portion of an imaging member with an inked patterned dampening fluid layer disposed thereover according to an embodiment of the present disclosure.

As shown in FIG. 6, inking subsystem 18 may then provide ink over the surface of layer 54. Due to the nature of the ink, reimageable surface 32, the composition of the dampening fluid comprising layer 54, and the physical arrangements of the elements of the inking subsystem 18, ink selectively fills ink-receiving wells 86 (FIG. 5). By providing a precisely controlled thickness of layer 54, the extent, profile, and other attributes of each ink-receiving well are well controlled, the amount of ink filling each ink-receiving well is controlled, and ultimately the quality of the resulting image applied to the substrate is therefore improved and consistent.

It will be appreciated that while each of the above-disclosed embodiments have operated as a nozzle (or array of nozzles) exhausting a dampening fluid steam in the direction of reimageable surface 32 and the direction of motion of imaging member 12, with proper adjust of certain parameters and element locations, each of the above embodiments may operate such that a vacuum is the prime mover of dampening fluid steam—i.e., due to application of a vacuum, a dampening fluid steam is pulled over the surface of layer 32 so that it may condense thereover.

Figure 7:
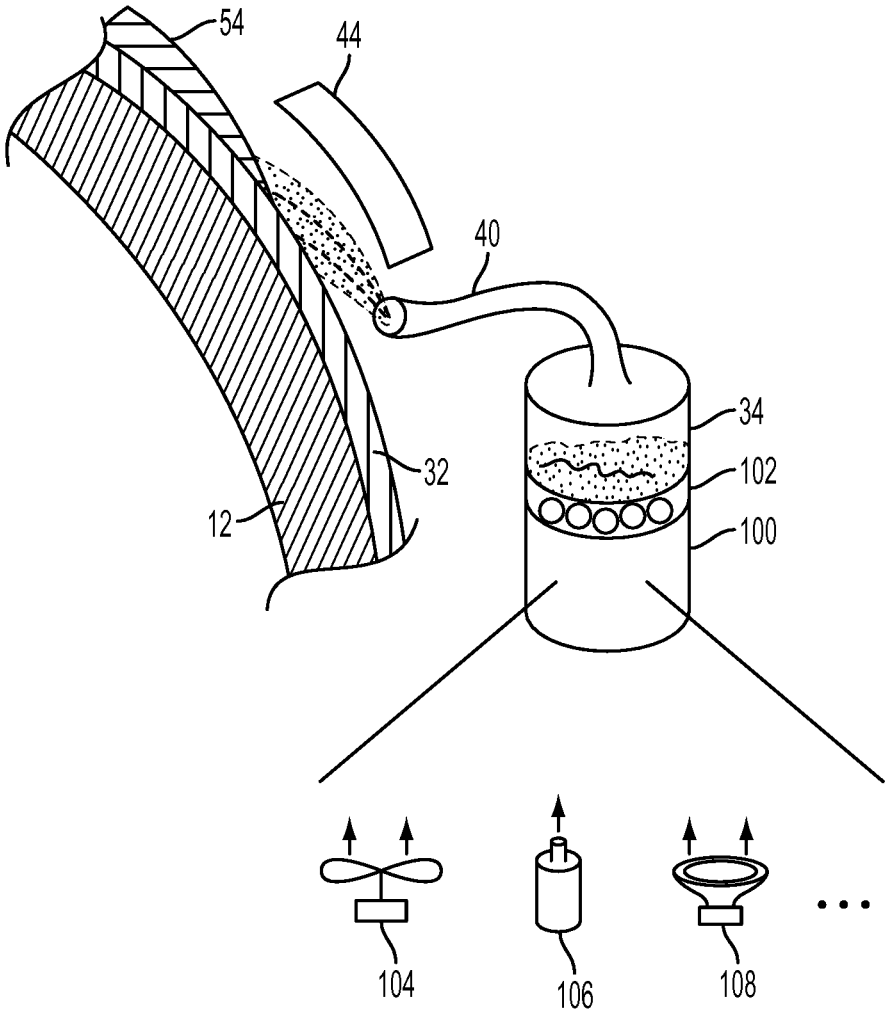
FIG. 7 is a side view of a portion of a system for variable lithography including a condensation-based dampening fluid subsystem and various apparatus for creating vaporized dampening fluid according to embodiments of the present disclosure.
Figure 8:
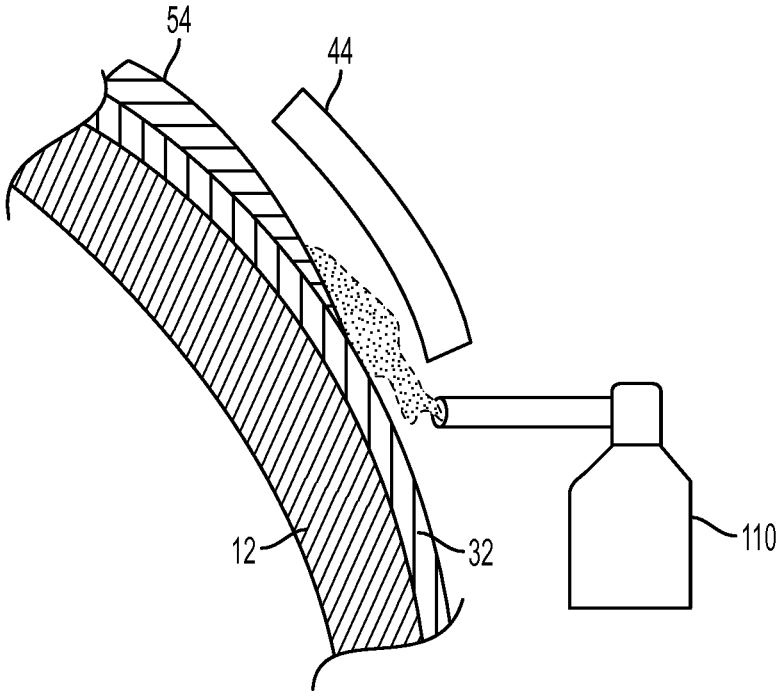
FIG. 8 is a side view of a portion of a system for variable lithography including a condensation-based dampening fluid subsystem and aerosol dampening fluid source according to an embodiment of the present disclosure.

While the description above has been in terms of a pure dampening fluid "steam", in which the dampening fluid is homogeneously mixed with air at the molecular level, other forms of an airborne state of dampening fluid are within the scope of the present disclosure such as a mist (airborne form of small droplets) of the dampening fluid. Typically, the air portion of the mist will have higher vapor pressure due to greater area of the fluid-air interface. In general, devices for creating the airborne state of the dampening fluid are referred to as vapor generators. Such vapor generators may provide their own particulate transport, such as a gas flow, or may be utilized with a separate particulate transport device. For example, dampening fluid may be atomized, nebulized, or otherwise made to be in particulate form and airborne for the purpose of transporting same by way of a gas flow to the reimageable surface of an imaging member in a variable data lithography system. With reference to FIG. 7, one example from a wide variety of possible vapor generators 100 with transport may be used to create and provide the airborne form of the dampening fluid. For example, resistive heating elements 102 heat dampening fluid to a temperature at which vapor releases from the surface thereof (alternatives to a resistive heating element include a radiation source, an optical source, an acoustic source, a thermally conductive source, and so on). An airflow device such as a fan 104, a pressurized source 106, an acoustic device 108, and so forth may be used to generate an airflow to carry the dampening fluid from dampening fluid in reservoir 24. Alternatively, dampening fluid may initially be provided to the system in an aerosol form from an appropriate storage vessel 110, as illustrated in FIG. 8.

Accumulation of the dampening fluid from the airborne state into a liquid layer on the reimageable surface may be controlled in a variety of ways. The rate of vapor generation may be controlled, for example by controlling the temperature of a heating element associated with the dampening fluid reservoir. The flow rate of the transport may be controlled to adjust condensation rate. The temperature and pressures of the respective devices and vapor containing and transport regions may also be controlled.

No limitation in the description of the present disclosure or its claims can or should be read as absolute. The limitations of the claims are intended to define the boundaries of the present disclosure, up to and including those limitations. To further highlight this, the term "substantially" may occasionally be used herein in association with a claim limitation (although consideration for variations and imperfections is not restricted to only those limitations used with that term). While as difficult to precisely define as the limitations of the present disclosure themselves, we intend that this term be interpreted as "to a large extent", "as nearly as practicable", "within technical limitations", and the like.

Furthermore, while a plurality of preferred exemplary embodiments have been presented in the foregoing detailed description, it should be understood that a vast number of variations exist, and these preferred exemplary embodiments are merely representative examples, and are not intended to limit the scope, applicability or configuration of the disclosure in any way. Various of the above-disclosed and other features and functions, or alternative thereof, may be desirably combined into many other different systems or applications. Various presently unforeseen or unanticipated alternatives, modifications variations, or improvements therein or thereon may be subsequently made by those skilled in the art which are also intended to be encompassed by the claims, below.

Therefore, the foregoing description provides those of ordinary skill in the art with a convenient guide for implementation of the disclosure, and contemplates that various changes in the functions and arrangements of the described embodiments may be made without departing from the spirit and scope of the disclosure defined by the claims thereto.

What is claimed is:

1. A subsystem for forming a dampening fluid layer over a reimageable surface of an imaging member in a variable data lithography system, comprising:

a dampening fluid reservoir configured to provide dampening fluid in an airborne state to said reimageable surface;

a flow conduit communicatively coupled to said dampening fluid reservoir and within which said airborne dampening fluid may travel from said dampening fluid reservoir toward said reimageable surface;

a flow control structure for confining airborne dampening fluid provided from said flow conduit to a condensation region to support forming a dampening fluid layer on said reimageable surface by way of condensation of said airborne dampening fluid over said reimageable surface;

an extraction subsystem for extracting excess airborne dampening fluid that does not condense over said reimageable surface from said condensation region;

a barrier structure configured to be disposed between said flow control structure and an optical patterning subsystem in a direction of travel of said imaging member to prevent evaporated dampening fluid from settling on said dampening fluid layer following evaporation and to otherwise prevent disturbing said dampening fluid layer between the point of evaporation and the optical patterning subsystem;

a controller to compare a thickness of said dampening fluid layer at a location following said condensation region to a target thickness so as to generate control signals to increase or decrease the flow of dampening fluid in an airborne state and for controlling temperature at the flow control structure and the reimageable surface; and a valve responsive to a control signal from the generated control signals to control the flow of airborne dampening fluid in an airborne state between said dampening fluid reservoir and said condensation region.

2. The subsystem for forming a dampening fluid layer of claim 1, wherein said airborne state of the dampening fluid is in a vapor state with a vapor pressure higher than a saturated vapor pressure at the reimageable surface.

3. The subsystem for forming a dampening fluid layer of claim 1, further comprising:

a vapor generator communicatively coupled to said dampening fluid reservoir for creating a vapor state of the dampening fluid contained in said dampening fluid reservoir; and nozzles disposed at the flow control structure such that a pressurized gas exits there from in the direction of said reimageable surface.

4. The subsystem for forming a dampening fluid layer of claim 3, further comprising a gas transport device for transporting particles of said dampening fluid vapor from said dampening fluid reservoir to said reimageable surface.

5. The subsystem for forming a dampening fluid layer of claim 1, further comprising a heating element communicatively coupled to said flow control structure for maintaining said flow control structure at a temperature exceeding a temperature of said reimageable surface in said condensation region such that condensation of dampening fluid on said flow control structure is inhibited.

6. The subsystem for forming a dampening fluid layer of claim 1, wherein said extraction subsystem is a vacuum extraction subsystem configured to extract said excess airborne dampening fluid that does not condense over said reimageable surface from said condensation region without affecting said dampening fluid layer outside of said condensation region.

7. The subsystem for forming a dampening fluid layer of claim 6, further comprising a dampening fluid reservoir, communicatively coupled to said extraction subsystem, for collecting and recycling dampening fluid extracted from said condensation region for reuse by said dampening fluid subsystem.

8. The subsystem for forming a dampening fluid layer of claim 1, further comprising a thickness sensor for determining the thickness of said dampening fluid layer at a location following said condensation region.

9. The subsystem for forming a dampening fluid layer of claim 8, wherein said controller is configured such that a thickness determined by said thickness sensor may be compared to a target thickness and in response to said comparison said controller may provide a signal to said flow control device to adjust the flow of said airborne dampening fluid to thereby control the extent of condensation of said dampening fluid.

10. The subsystem for forming a dampening fluid layer of claim 9, wherein said controller is communicatively coupled to a control mechanism for actuating an apparatus for controlling aspects of the extent of condensation of said airborne dampening fluid.

11. A variable data lithography system, comprising:

an imaging member having an arbitrarily reimageable surface;

a dampening fluid subsystem for applying a layer of dampening fluid to said reimageable surface, comprising: a dampening fluid reservoir configured to provide dampening fluid in an airborne state to said reimageable surface;

a flow conduit communicatively coupled to said dampening fluid reservoir and within which said airborne dampening fluid may travel from said dampening fluid reservoir toward said reimageable surface;

a flow control structure for confining airborne dampening fluid provided from said flow conduit to a condensation region to support forming said layer of dampening fluid on said reimageable surface by way of condensation of said airborne dampening fluid over said reimageable surface, wherein the flow control structure has one or more slots disposed such that a pressurized gas exits therefrom in the direction of said reimageable surface;

a plurality of control devices to maintain the flow control structure at a temperature higher than the reimageable surface and to operate a heating element in the dampening fluid reservoir thereby to control the temperature of the dampening fluid in the airborne state;

an extraction subsystem for extracting excess airborne dampening fluid that does not condense over said reimageable surface from said condensation region;

a patterning subsystem for selectively removing portions of the dampening fluid layer so as to produce an image in the dampening fluid;

a barrier structure configured to be disposed between said flow control structure and the patterning subsystem in a direction of travel of said imaging member to prevent evaporated dampening fluid from settling on said dampening fluid layer following evaporation and to otherwise prevent disturbing said dampening fluid layer between the point of evaporation and the patterning subsystem;

a controller to compare a thickness of said dampening fluid layer at a location following said condensation region to a target thickness so as to generate control signals;

an inking subsystem for applying ink over the reimageable surface such that said ink selectively occupies regions where dampening fluid was removed by the patterning subsystem to thereby form an inked latent image;

an image transfer subsystem for transferring the inked latent image to a substrate; and a cleaning subsystem for removing residual ink and dampening fluid from the reimageable surface.

12. The variable data lithography system of claim 11, wherein said reimageable surface has a temperature and corresponding saturated vapor pressure, and further wherein said airborne state of the dampening fluid is a vapor state with a vapor pressure great than the saturated vapor pressure at the temperature of reimageable surface.

13. The variable data lithography system of claim 11, wherein said dampening fluid reservoir is further configured to contain dampening fluid in a liquid state, and wherein said heating element is a vapor generator communicatively coupled to said dampening fluid reservoir for creating particulate vapor state of the dampening fluid contained in said dampening fluid reservoir.

14. The variable data lithography system of claim 11, further comprising a thickness sensor for determining the thickness of said dampening fluid layer at a location following said condensation region.

15. The variable data lithography system of claim 14, further comprising a flow control device controlling the flow of airborne dampening fluid between said dampening fluid reservoir and said condensation region, and further comprising a controller communicatively coupled to said thickness sensor and said flow control device, said controller configured such that a thickness determined by said thickness sensor may be compared to a target thickness and in response to said comparison said controller may provide a signal to said flow control device to adjust the flow of said airborne dampening fluid to thereby control the extent of condensation of said dampening fluid.

16. A subsystem for forming a dampening fluid layer over a reimageable surface of an imaging member in a variable data lithography system, comprising:

a dampening fluid reservoir configured to provide dampening fluid in an airborne state to said reimageable surface, wherein the dampening fluid is selected from a group consisting of hexafluoropropoxy or octamethylcyclotetrasiloxane;

a flow conduit communicatively coupled to said dampening fluid reservoir and within which said airborne dampening fluid may travel from said dampening fluid reservoir toward said reimageable surface;

an apparatus to control temperature of the reimageable surface;

a flow control structure for confining airborne dampening fluid provided from said flow conduit to a condensation region to support forming a dampening fluid layer on said reimageable surface by way of condensation of said airborne dampening fluid over said reimageable surface;

a gas transport device for transporting particles of said dampening fluid vapor from said dampening fluid reservoir to said reimageable surface;

a thickness sensor for determining the thickness of said dampening fluid layer at a location following said condensation region;

an extraction subsystem for extracting excess airborne dampening fluid that does not condense over said reimageable surface from said condensation region;

a barrier structure configured to be disposed between said flow control structure and an optical patterning subsystem in a direction of travel of said imaging member to prevent evaporated dampening fluid from settling on said dampening fluid layer following evaporation and to otherwise prevent disturbing said dampening fluid layer between the point of evaporation and the optical patterning subsystem;

a control mechanism for controlling aspects of the extent of condensation of said airborne dampening fluid by:

controlling temperature of said flow control structure;

controlling vapor concentration of the dampening fluid of an ambient proximate said reimageable surface;

controlling temperature of the reimageable surface; and controlling exposure time of said reimageable surface to the airborne dampening fluid.

17. An apparatus in a variable data lithography system to form a dampening fluid layer over a reimageable surface of an imaging member, comprising:

a dampening fluid reservoir configured to provide dampening fluid in an airborne state to said reimageable surface, wherein the dampening fluid is selected from a group consisting of hexafluoropropoxy, water, and octamethylcyclotetrasiloxane;

a flow conduit communicatively coupled to said dampening fluid reservoir and within which said airborne dampening fluid may travel from said dampening fluid reservoir toward said reimageable surface;

a flow control structure for confining airborne dampening fluid provided from said flow conduit to a condensation region to support forming a dampening fluid layer on said reimageable surface by way of condensation of said airborne dampening fluid over said reimageable surface;

a gas transport device for transporting particles of said dampening fluid vapor from said dampening fluid reservoir to said reimageable surface;

a flow control device controlling the flow of airborne dampening fluid between said dampening fluid reservoir and said condensation region, and further comprising a controller communicatively coupled to said thickness sensor and said flow control device, said controller configured such that a thickness determined by said thickness sensor may be compared to a target thickness and in response to said comparison said controller may provide a signal to said flow control device to adjust the flow of said airborne dampening fluid to thereby control the extent of condensation of said dampening fluid;

an apparatus that controls vapor concentration of the dampening fluid of an ambient proximate said reimageable surface;

an apparatus that controls temperature of the reimageable surface;

an apparatus that controls exposure time of said reimageable surface to the airborne dampening fluid;

a barrier structure configured to be disposed between said flow control structure and an optical patterning subsystem in a direction of travel of said imaging member to prevent evaporated dampening fluid from settling on said dampening fluid layer following evaporation and to otherwise prevent disturbing said dampening fluid layer between the point of evaporation and the optical patterning subsystem; and an extraction subsystem for extracting excess airborne dampening fluid that does not condense over said reimageable surface from said condensation region;

wherein said controller is communicatively coupled to a control mechanism for actuating, in response to said comparison of said thickness and said target thickness, an apparatus for controlling aspects of the extent of condensation of said airborne dampening fluid selected from the group consisting of: an apparatus that controls a temperature of the airborne dampening fluid flowing to said condensation region.

* * * * *